United States Patent [19]

Sato

[11] 4,206,703

[45] Jun. 10, 1980

[54] CONSTANT PRINTING PRESSURE MECHANISM FOR PORTABLE LABEL PRINTING MACHINE, OR THE LIKE

[75] Inventor: Yo Sato, Tokyo, Japan

[73] Assignee: Kabushiki Kaisha Sato, Tokyo, Japan

[21] Appl. No.: 901,084

[22] Filed: Apr. 28, 1978

[30] Foreign Application Priority Data

May 16, 1977 [JP] Japan ..... 52-55284

[51] Int. Cl.[2] ..... B41J 5/00

[52] U.S. Cl. ..... 101/291; 101/288; 101/93.03; 101/298; 101/316; 400/167; 400/435; 400/652; 400/687; 156/384

[58] Field of Search ..... 156/384; 101/287, 288, 101/291, 292, 316, 297, 298, 10, 20, 93.02, 93.03; 400/157.3, 166, 167, 388, 388.1, 389, 397, 424, 428, 435, 437, 440.2, 648, 649, 652, 686, 687; 267/158; 227/132; 74/97, 2; 173/118, 120, 139; 251/75-78, 80, 251, 262, 263

[56] References Cited

U.S. PATENT DOCUMENTS

| | | | |
|---|---|---|---|
| 2,073,902 | 3/1937 | Clivetti | 400/652 |
| 2,523,855 | 9/1950 | Zgranik | 400/652 |
| 2,875,879 | 3/1959 | Auerbach | 400/389 |
| 3,807,542 | 4/1974 | Jung | 400/167 |

*Primary Examiner*—William Pieprz

*Attorney, Agent, or Firm*—Ostrolenk, Faber, Gerb & Soffen

[57] ABSTRACT

A constant pressure printing mechanism for use in a label printing machine: the platen is pivotally secured to the machine body; the pivotally supported, hand operated printing levers include a projection, which engages a pivotally supported platen lifting member, and the lifting member is pivoted by the projection to turn the platen toward the printing head, whereby the printing head and the platen are moved near to each other to perform the printing of labels.

27 Claims, 3 Drawing Figures

CONSTANT PRINTING PRESSURE MECHANISM FOR PORTABLE LABEL PRINTING MACHINE, OR THE LIKE

BACKGROUND OF THE INVENTION

1. Field of the Invention

This invention relates to a constant pressure printing mechanism for a portable label printing machine, or the like (hereinafter a labeler). The mechanism regulates printing pressure for obtaining clear and precise printing of labels without differences in the darkness of the printed characters on labels and without double printing.

2. Description of the Prior Art

In conventional labelers, a hand operated lever and a printing lever for carrying a printing head integrally form a working lever. A printing head is attached to the front end of the printing lever. The working lever is pivotally secured to the machine frame. The printing lever carrying the printing head is moved, and more particularly, turned downward, when the hand lever is squeezed. This moves the type faces at the underside of the printing head into contact with the surface of a tape-like label strip that is carried on a platen, thereby printing the labels.

In conventional labelers, however, the intensity of the squeeze of the hand lever directly influences the pressure of the printing stroke. The darkness of the printed characters is liable to vary according to the intensity of the squeezing force applied to the hand lever. Further, when the hand lever is squeezed too strongly and/or quickly, the platen is struck with great force and the printing head bounces on the label placed on the platen causing double printing. Precise printing is thus difficult to achieve.

In the past, even when labels were somewhat indistinctly printed by conventional labelers, they were accepted because customers can read them when they purchase commodities and cashiers can also read them when they total the purchases. In recent years, the figures, symbols (bar codes, OCR characters, etc.), and the like, that are being printed on labels are being read by computerized optical readers in place of cashiers in order to put what is called POS (point of sales) system into practice. In this system, information concerning stocks, sales, customers' data, profit and loss, and other management data are memorized and processed by electronic computers. To enable accurate machine reading of labels, it has become necessary for the labels to always be printed with clear consistent quality, precise characters and symbols.

SUMMARY OF THE INVENTION

It is, therefore, the primary object of the present invention to provide an improved constant pressure printing mechanism for use in a portable label printing machine, or the like, which mechanism is quite effectively achieving clear, precise and consistent printing of labels, without double printing.

It is another object to provide a constant pressure printing mechanism which is reliable in operation, simple in structure and durable, even in severe use.

In accordance with the present invention, the constant pressure printing mechanism includes the following features. The platen that supports the tape-like label strip for being printed is pivotally secured to the machine body. When the printing lever carrying the printing head is moved toward the platen, an operator portion of the printing lever or of the printing head and a portion of the platen or of a member which is interlocked to the platen are brought into contact with each other so as to turn up the platen slightly toward the printing head. Thus, the printing head and the label strip on the platen are moved toward each other to perform the printing of a label. To turn down the printing lever, the hand lever is squeezed. In a preferred embodiment, a portion of the printing head on its underside is a pushing projection which engages a platen lifting member which is interlocked to the platen for lifting the platen. The platen is pivoted up by the lifting member. The lifting member is separately pivotally mounted to the frame and engages and lifts the platen as the lifting member is pivoted by being engaged by the pushing projection. The platen, the printing lever and the lifting member are all biased to return to their initial positions.

BRIEF DESCRIPTION OF THE DRAWINGS

Other objects and features of the invention are described with respect to a preferred embodiment of the invention shown in the accompanying drawings, in which.

DESCRIPTION OF THE PREFERRED EMBODIMENT

Figure 1:
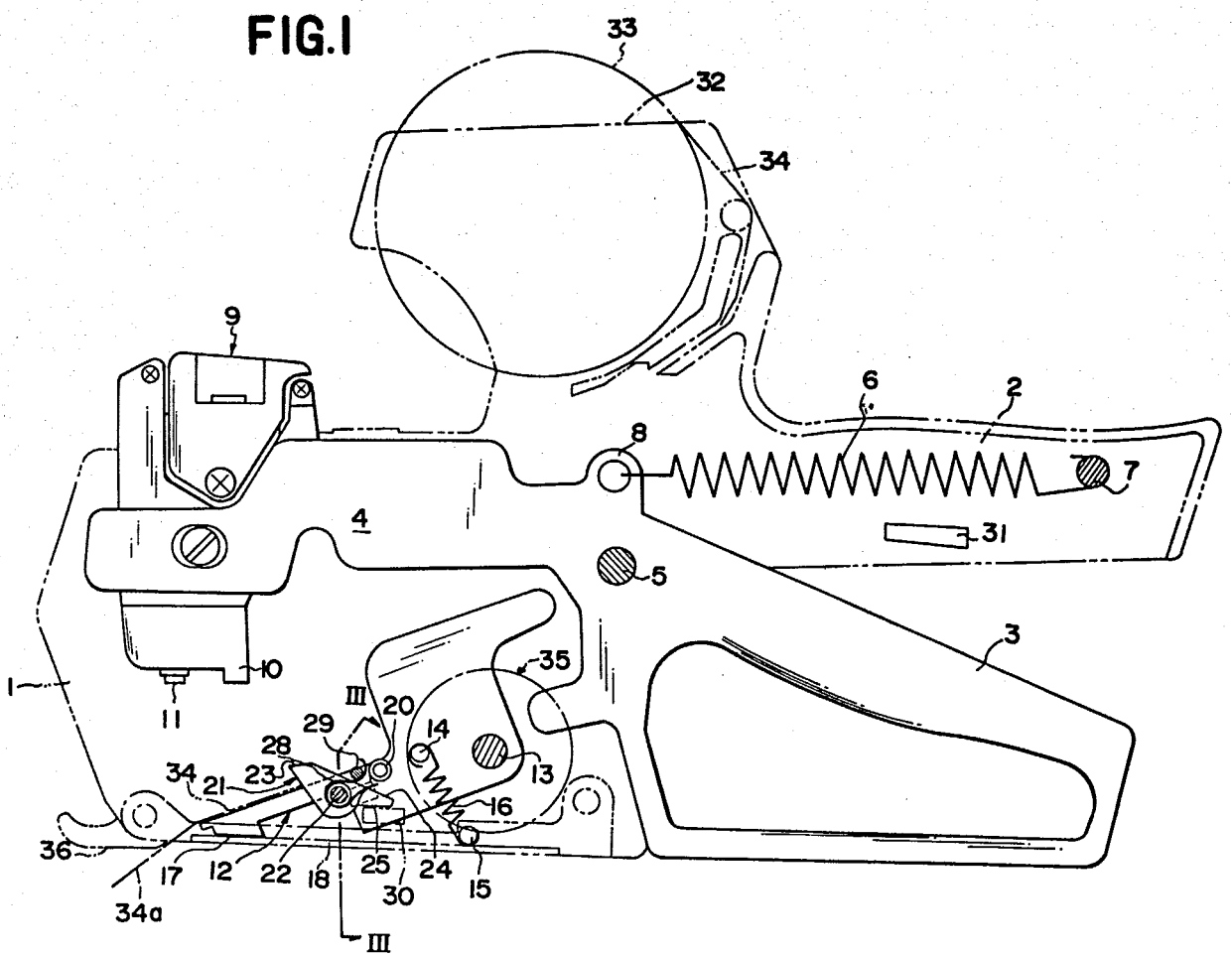
FIG. 1 is a partially cross-sectional, side elevational view of a label printing machine having the constant pressure printing mechanism of the invention, shown in the rest position.

FIG. 1 shows an embodiment of the constant pressure printing mechanism of the present invention. The labeler includes two spaced apart machine side frames 1 between which the other labeler components are carried. On the rear parts (at the right side in FIG. 1) of both of the machine frames 1, the hand grip 2 is integrally formed.

There is an integral hand lever 3 and a bifurcated printing lever 4 which are pivotally secured by the pivot shaft 5 between the machine frames 1. A return spring 6 is stretched between a spring pin 7, which is formed in the hand grip 2, and a spring supporting projection 8, which is formed on the rear (right hand) part of the printing lever 4 above the pivot 5. Both the hand lever 3 and the printing lever 4 are always urged clockwise (in FIG. 1) by the return spring 6.

A printing head 9 is disposed in the space between the front parts of the arms of the bifurcated printing lever 4. The undersurface of the printing head 9 carries an operator, i.e. a pushing projection, 10 that is brought into engagement with the lifting member 21, as described below. Further, in front of the projection 10, the undersurface of the printing head carries types 11 for printing a label.

Figure 3:
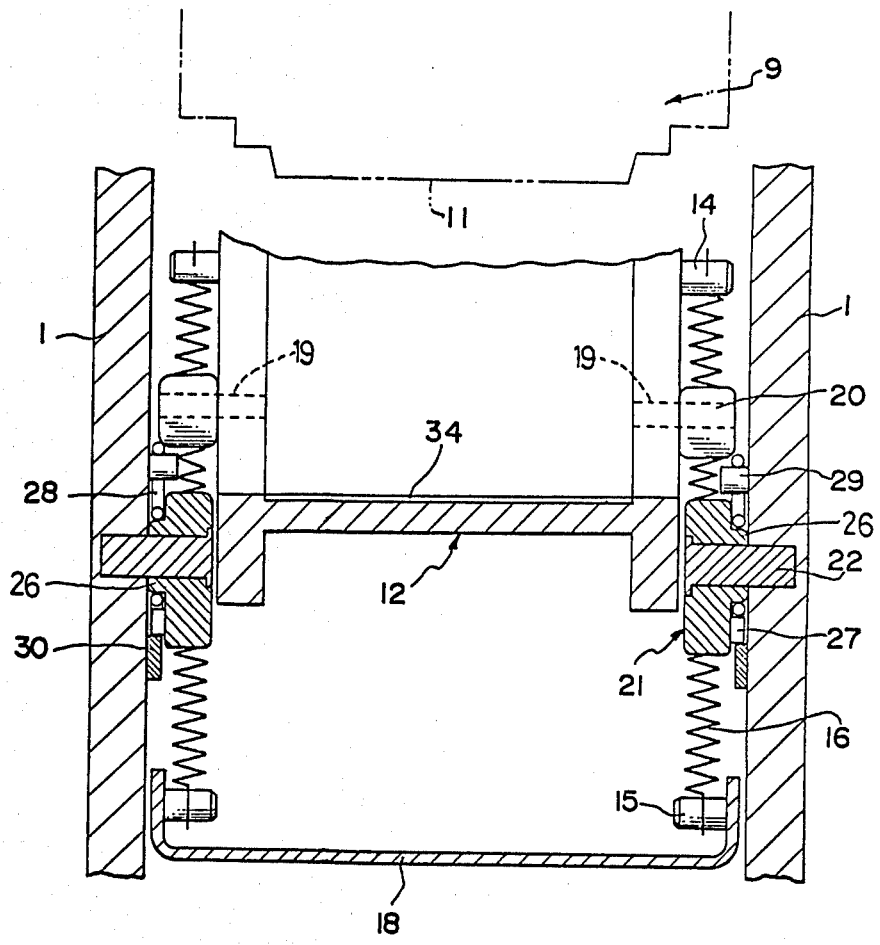
FIG. 3 is an enlarged cross-sectional view of the constant pressure printing mechanism viewed along the line III—III in FIG. 1.

There is a platen 12 which is pivotally secured to and between the machine frames 1 by a pivot shaft 13. As shown in FIGS. 1 and 3, a respective tensioned return spring 16 is attached on each side of the platen 12. Each spring 16 is stretched between a spring supporting pin 14 that is fixed to the respective side wall of the platen 12 and another spring supporting pin 15 which is fixed to the respective side wall of the stationary bottom cover 18 of the labeler. The return spring 16 always urges the platen 12 counterclockwise (in FIG. 1). This urges the undersurface 17 at the front part of the platen 12 into contact with the bottom cover 18. A roller 20 is rotatively attached by a roller shaft 19 to each side plate of the platen 12. The roller 20 serves as an abutting means.

A respective one of a pair of lifting members 21 is pivotally attached to the inside wall of each machine frame 1 by a respective fitting shaft 22. Each lifting member 21 has a receiving surface 23 at its upper front portion, a lifting surface 24 at its upper rear portion, and a stopping surface 25 at its lower rear portion. The surface 24 serves as another abutting means that cooperates with the roller 20. As shown in FIG. 3, the outside of each lifting member 21 is provided with an annular projection 26 around the fitting shaft 22 and with a spring support projection 27 in the rear part of the lifting member 21. The torsion spring 28 is fitted around the annular projection 26. One end of the spring 28 is supported by the spring support projection 27 on the lifting member and the other end of the spring 28 is held against a pin 29 which is attached to the inside wall of the machine frame 1. The lifting member 21 is thus urged always clockwise to a released position. In the released position shown in FIG. 1, the stopping surface 25 of the lifting member 21 is biased into contact with the stopper 30 that is formed on the inside wall of the machine frame 1, so that the lifting member 21 can be turned only in the counterclockwise direction to the platen lifting position.

A stopper 31 is fixed inside the hand grip 2 and the upper surface of the hand lever 3 abuts stopper 31 when the lever 3 is squeezed, thereby limiting the extent to which the lever 3 can be squeezed.

There is a holder 32 for a rolled label strip 33. The tape-like label strip 34 paid out from the rolled label strip 33 is transferred onto the platen 12 by a known feeding mechanism 35.

The operation of the constant pressure printing mechanism of the present invention is now described. FIG. 1 shows the rest position of the labeler. When the hand grip 2 and the hand lever 3 are squeezed together to turn the hand lever upward (counterclockwise), the printing lever 4 that is formed integrally with the hand lever 3 is turned downward about the pivot shaft 5 and this moves the printing head 9 down. During this motion, an inking roller (not shown) rolls on the types 11 on the bottom of the printing head 9 to ink the type faces. As the hand lever 3 is squeezed further, the pushing projection 10 on the lower rear side of the printing head 9 first comes into contact with the receiving surface 23 of the lifting member 21 to push down the receiving surface 23 before the faces of the types 11 of the printing head 9 are moved into contact with the tape-like label strip 34 carried on the platen 12. Accordingly, the lifting member 21 is turned counterclockwise about the fitting shaft 22 against the force of the spring 28.

Figure 2:
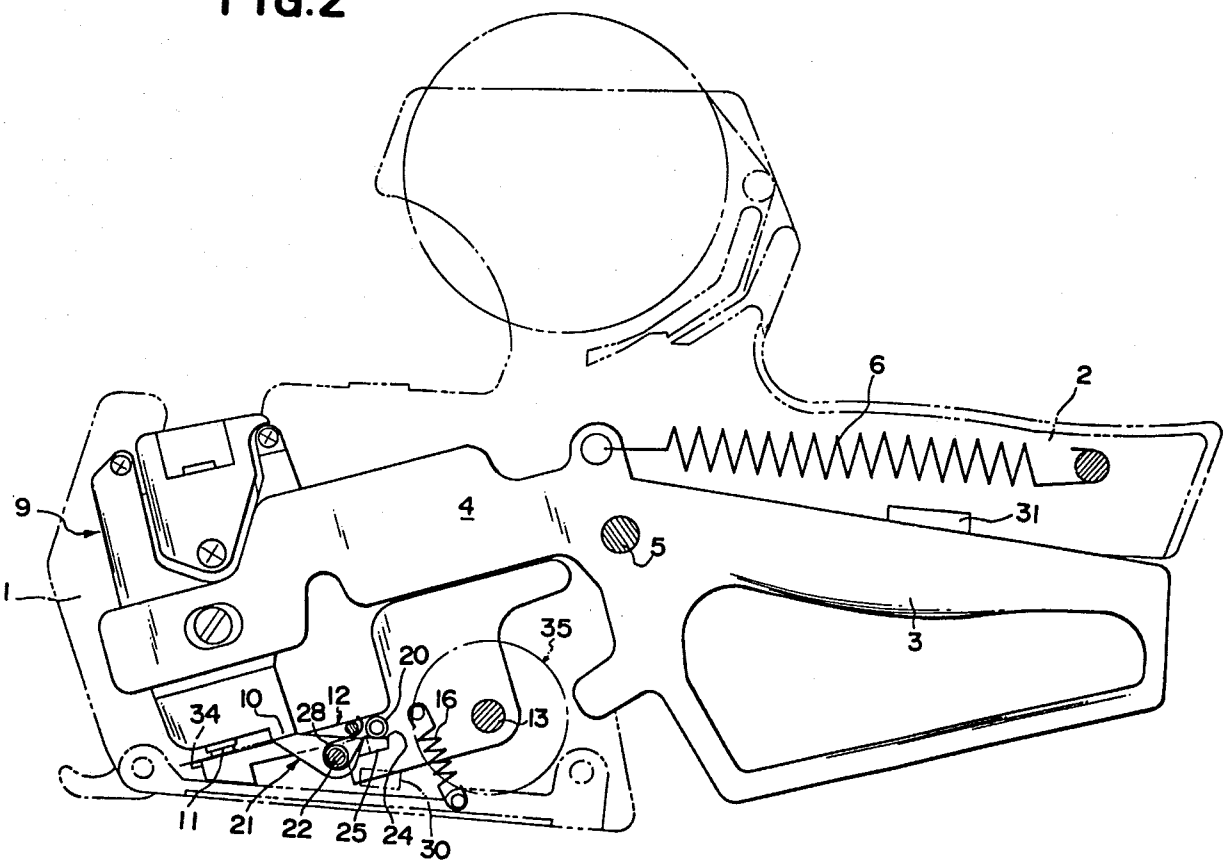
FIG. 2 is the same view as FIG. 1, with the label printing machine in the printing position.

The turning movement of the lifting member 21 raises the lifting surface 24 of the lifting member 21 into engagement with the roller 20 that is attached on the side wall of the platen 12. The roller 20 is pushed up and lifted and this turns the platen 12 clockwise about the pivot shaft 13 against the force of the return spring 16. Accordingly, as shown in FIG. 2, the types 11 of the printing head 9 that is moving down come into contact with the tape-like label strip 34 on the platen 12 that is moving up. Upon such contact, the surface of a label on the platen is printed. Further, the upper surface of the hand lever 3 is squeezed into contact with the stopper 31 formed in the hand grip 2, so that the printing levers 4 and the printing head 9 are thereafter blocked from further movement, and excessive pressure contact between the faces of the types 11 and the label surface can be avoided. Therefore, excessively dark printing can be prevented.

Next, when the hand lever 3 is released, the hand lever 3 and the printing levers 4 are turned clockwise about the pivot shaft 5 by the tension of the return spring 6. This moves the printing head 9 upward. At the same time, the lifting member 21 is turned clockwise to the released position by the force of the spring 28 until the stopping surface 25 contacts the stopper 30. Further, the platen 12 is turned counterclockwise by the force of the return spring 16. The mechanism is thereby returned to the state shown in FIG. 1.

Simultaneously with the above working, the tape-like label strip 34 is shifted forward by the length of one label piece by the feeding mechanism 35, and the previously printed label 34*a* is paid out under the applicator 36.

The configurations and the positions of the pushing projection 10, the lifting member 21, etc. are not restricted to the precise form shown herein. Furthermore, the constant printing pressure mechanism of the present invention can be used not only in a portable label printing machine but also in other printing machines, such as price tag attaching machines and desk-type label printing machines.

As described above, in the present invention, when the type faces of the printing head are moved near the label surface by the squeezing of the hand lever, the platen carrying the label is moved toward the printing head in interlocked relationship. The type faces and the label surface are brought into contact with each other to print a label. Accordingly, the following advantages and effects can be expected.

(1) Even when the squeezing force is weak, the type faces and the label surface approach and press mutually, so that printing can always be accomplished under a certain pressure. Accordingly, the printed characters do not become vague and clear printing of the proper darkness can always be attained.

(2) Further, when the hand lever is squeezed quite strongly and/or rapidly, another part of the printing head or the printing lever first contacts the platen or a member that is attached to the platen before the type faces are brought into contact with the label surface, so that the printing pressure can be moderated properly. Furthermore, since the type faces and the label surface are brought near and then pressed to each other, the shock of impact on and the rebounding on the platen can be avoided. As a result, double printing can be prevented.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A constant pressure printing mechanism for a label printing machine, or the like, comprising:

a frame;

a platen movably supported by said frame and movable toward and away from a printing head;

a printing lever for being operated to move toward and away from said platen; a printing head carried by said printing lever and movable thereby toward and away from said platen; said printing head carrying types and said printing head types facing toward said platen and being abuttable therewith upon said printing lever moving said printing head to said platen;

a lifting member rockably connected to said frame for rocking with respect to said frame; said lifting member being rockable in one direction to a platen lifting position, and during such rocking movement, said lifting member lifts said platen toward said printing head; said lifting member being rockable in a second direction, opposite said one direction to a platen released position, and during such rocking movement in said second direction, said lifting member rocks to permit said platen to move away from said printing head;

an operator rigidly connected with said printing lever and movable therewith and positioned and shaped for being separated from said lifting member and for remaining separated from said lifting member until said types approach said platen; said operator engaging said lifting member upon said types approaching said platen but before said types abut said platen and said operator engaging said lifting member at a location for rocking said lifting member to said platen lifting position thereof.

2. The constant pressure printing mechanism of claim 1, further comprising a stopper on said frame for blocking said printing lever from moving beyond a predetermined distance to said platen.

3. The constant pressure printing mechanism of claim 1, further comprising biasing means for biasing said platen away from said printing head.

4. The constant pressure printing mechanism of either of claims 1 or 3, further comprising biasing means for biasing said lifting member to said platen released position.

5. The constant pressure printing mechanism of claim 4, further comprising means for biasing said printing lever away from said platen.

6. The constant pressure printing mechanism of claim 1, wherein said platen is pivotally supported to pivot with respect to said frame toward and away from said printing head.

7. The constant pressure printing mechanism of claim 6, further comprising biasing means for biasing said platen away from said printing head.

8. The constant pressure printing mechanism of either of claims 1 or 6, wherein said printing lever is pivotally supported to said frame for pivotally moving toward and away from said platen.

9. The constant pressure printing mechanism of claim 8, further comprising means for biasing said printing lever away from said platen.

10. The constant pressure printing mechanism of claim 9, further comprising a stopper on said frame for blocking said printing lever from moving beyond a predetermined distance to said platen.

11. The constant pressure printing mechanism of either of claims 1 or 6, wherein said operator comprises a projection extending beneath said printing lever at the side of said printing lever on which said printing types are located.

12. The constant pressure printing mechanism of claim 11, wherein said projection is on said printing head.

13. The constant pressure printing mechanism of claim 11, wherein said lifting member is supported at a pivot on said frame for rocking by pivoting with respect to said frame between its said positions; said lifting member includes a receiving surface for being engaged by said operator for being moved in the direction of motion of said printing lever by said operator; said lifting member includes a lifting surface on the opposite side of said lifting member pivot from said receiving surface and said lifting surface being lifted toward said printing lever as said printing lever moves toward said platen; said lifting surface engages and abuts said platen as said lifting member is engaged by said operator and said lifting surface moves said platen toward said types as said printing lever continues moving toward said platen.

14. The constant pressure printing mechanism of claim 1, wherein said lifting member is supported at a pivot on said frame for rocking by pivoting with respect to said frame between its said positions; said lifting member includes a receiving surface for being engaged by said operator for being moved in the direction of motion of said printing lever by said operator; said lifting member includes a lifting surface on the opposite side of said lifting member pivot from said receiving surface and said lifting surface being lifted toward said printing lever as said printing lever moves toward said platen; said lifting surface engages and abuts said platen as said lifting member is engaged by said operator and said lifting surface moves said platen toward said types as said printing lever continues moving toward said platen.

15. The constant pressure printing mechanism of claim 14, further comprising biasing means for biasing said lifting member to said released position.

16. The constant pressure printing mechanism of claim 14, wherein said platen is pivotally supported to pivot with respect to said frame toward and away from said printing head.

17. The constant pressure printing mechanism of claim 16, further comprising biasing means for biasing said lifting member to said released position.

18. The constant pressure printing mechanism of claim 17, further comprising biasing means for biasing said platen away from said printing head.

19. The constant pressure printing mechanism of claim 18, further comprising means for biasing said printing lever away from said platen.

20. The constant pressure printing mechanism of claim 19, further comprising a stopper on said frame for blocking said printing lever from moving beyond a predetermined distance to said platen.

21. The constant pressure printing mechanism of claim 18, wherein said printing lever is pivotally supported to said frame for pivotally moving toward and away from said platen.

22. The constant pressure printing mechanism of claim 14, wherein said platen comprises an arm having a printing portion thereon on which a label to be printed is supported and against which said printing types abut and further comprises a pivot portion away from said printing portion; said platen being pivotally mounted to said frame;

said lifting member being pivotally attached to said frame at a pivot located between said platen pivot and said platen printing portion;

said platen having respective abutting means which abut said lifting surface when said lifting member moves to said platen lifting position for lifting said platen; said platen abutting means and said lifting surface abutting at a location between said platen pivot and said lifting member pivot.

23. The constant pressure printing mechanism of claim 22, wherein said receiving surface is at the side of said lifting member pivot away from the side thereof with said lifting surface.

24. The constant pressure printing mechanism of claim 23, further comprising biasing means for biasing said platen away from said printing head;

biasing means for biasing said lifting member to said platen released position.

25. The constant pressure printing mechanism of claim 24, further comprising means for biasing said printing lever away from said platen.

26. The constant pressure printing mechanism of claim 22, wherein said operator comprises a projection extending beneath said printing lever at the side of said printing lever on which said printing types are located.

27. The constant pressure printing mechanism of claim 26, further comprising a stopper on said frame for blocking said printing lever from moving beyond a predetermined distance to said platen.

* * * * *